US005591058A

United States Patent [19]

Schriever et al.

[11] Patent Number: 5,591,058

[45] Date of Patent: Jan. 7, 1997

[54] EXHAUST ACCESSORY FOR BOATS

[76] Inventors: Frederick G. Schriever, 19950 Harper Ave., P.O. Box 36117, Detroit, Mich. 48236; Richard C. Mertz, Jr., 21711 Greater Mack, St. Clair Shores, Mich. 48080

[21] Appl. No.: 516,680

[22] Filed: Aug. 18, 1995

[51] Int. Cl.[6] ..... B63H 21/32

[52] U.S. Cl. ..... 440/89

[58] Field of Search ..... 440/88, 89; 114/67 R; 60/272; 181/212, 227, 238

[56] References Cited

U.S. PATENT DOCUMENTS

| | | | |
|---|---|---|---|
| 987,130 | 3/1911 | Geyer . | |
| 1,031,943 | 7/1912 | Lloyd-Horry . | |
| 1,054,301 | 2/1913 | Mathis | 440/89 |
| 1,198,274 | 9/1916 | Reece . | |
| 2,522,883 | 9/1950 | MacArthur . | |
| 2,713,841 | 7/1955 | Forbes | 440/89 |
| 2,859,830 | 11/1958 | Hoffar . | |
| 3,084,651 | 4/1963 | Parmenter . | |
| 3,568,672 | 3/1971 | Cupp . | |
| 3,907,061 | 9/1975 | Chapman et al. . | |
| 4,714,443 | 12/1987 | Chaplin et al. . | |

*Primary Examiner*—Stephen Avila
*Attorney, Agent, or Firm*—Brooks & Kushman P.C.

[57] ABSTRACT

Apparatus for preventing exhaust gases emitted from an exhaust pipe outlet at a boat transom from soiling the boat surfaces. The apparatus includes a normally flaccid tube encircling the exhaust pipe outlet. The tube becomes rigid and extends rearwardly from the transom upon receiving exhaust gases from the exhaust pipe outlet. The tube, when rigid, discharges the exhaust gases far enough away from the transom to reduce contact of the gases with the boat surfaces. In one embodiment, the tube is clamped directly to the exhaust pipe outlet. In a second embodiment, the tube is clamped directly to the boat transom via a flange encircling the exhaust pipe outlet.

6 Claims, 3 Drawing Sheets

EXHAUST ACCESSORY FOR BOATS

TECHNICAL FIELD

The present invention relates generally to marine exhaust systems and, more particularly, to an apparatus for preventing soiling of a boat transom by exhaust gases from the boat's inboard engine.

BACKGROUND ART

Boats powered by inboard engines discharge the exhaust gases, or fumes, from the engine to the outside environment through an exhaust pipe. The exhaust pipe normally projects outwardly through the boat transom, or at a location on the hull near the transom, in order to discharge the gases behind the boat. The exhaust pipe outlet is usually located above the water line of a moving boat in order to discharge the gases above the water surface to avoid back pressure.

A primary disadvantage with conventional marine exhaust systems is that the exhaust pipe discharges the fumes in the immediate locale of the boat transom. Depending on the shape and size of the transom, speed of the boat, and location of the exhaust pipe outlet, portions of the exhaust fumes can remain near the transom. Furthermore, the fumes can even follow a moving boat due to a partial vacuum "stationwagon effect" that exists behind moving boats. The exhaust fumes which come into contact with the boat, especially those from diesel combustion engines, can severely soil the boat surfaces, particularly the transom, resulting in lost time and cleaning expenses to restore the cleanliness of the boat.

The following patents show devices intended to reduce contact of exhaust gases with adjacent surfaces of the boat or its occupants or to reduce exhaust noises: U.S. Pat. Nos. 4,714,443, 3,907,061, 3,568,672, 3,084,651, 2,859,830, 2,522,883, 1,198,274, 1,031,943, and 987,130.

SUMMARY OF THE INVENTION

Accordingly, it is an object of the present invention to provide an apparatus for reducing or minimizing contact of exhaust gases emitted from a boat with the boat surfaces.

It is a further object of the present invention to provide an apparatus for maintaining the maneuverability and the aesthetic functionality of the boat.

In carrying out the above objects and other objects and features of the present invention, an apparatus is provided for reducing contact of exhaust gases generated by an inboard engine which are emitted from an exhaust pipe outlet at a boat transom with such transom. The apparatus comprises an elongated normally flaccid tube. The tube has an inlet end communicating with the exhaust pipe outlet at the transom and an outlet end. The tube becomes rigid and extends rearwardly from the transom upon operation of the inboard engine discharging the exhaust gases through the tube. When the tube is rigid, the outlet end of the tube is disposed sufficiently away from the transom to discharge the exhaust gases emitted from the exhaust pipe outlet remote from the transom to reduce the likelihood of the gases soiling the boat surfaces.

In one embodiment of the present invention, the tube is clamped to the exhaust pipe outlet to extend rearwardly therefrom and in another embodiment is mounted to the boat transom. In both embodiments, the tube encircles the exhaust outlet and should be of a length sufficient to direct the gases far enough away from the boat to prevent the gases from soiling the boat surfaces.

The advantages accruing to the present invention are numerous. For example, the apparatus of the present invention reduces contact of discharged exhaust gases with the boat and the consequent soiling of the boat surfaces. As a result, the cleanliness of the boat is maintained.

The above objects and other objects, features and advantages of the present invention will be readily appreciated by one of ordinary skill in the art from the following detailed description of the best modes for carrying out the present invention when taken in connection with the accompanying drawings.

BEST MODE FOR CARRYING OUT THE PRESENT INVENTION

Figure 1:
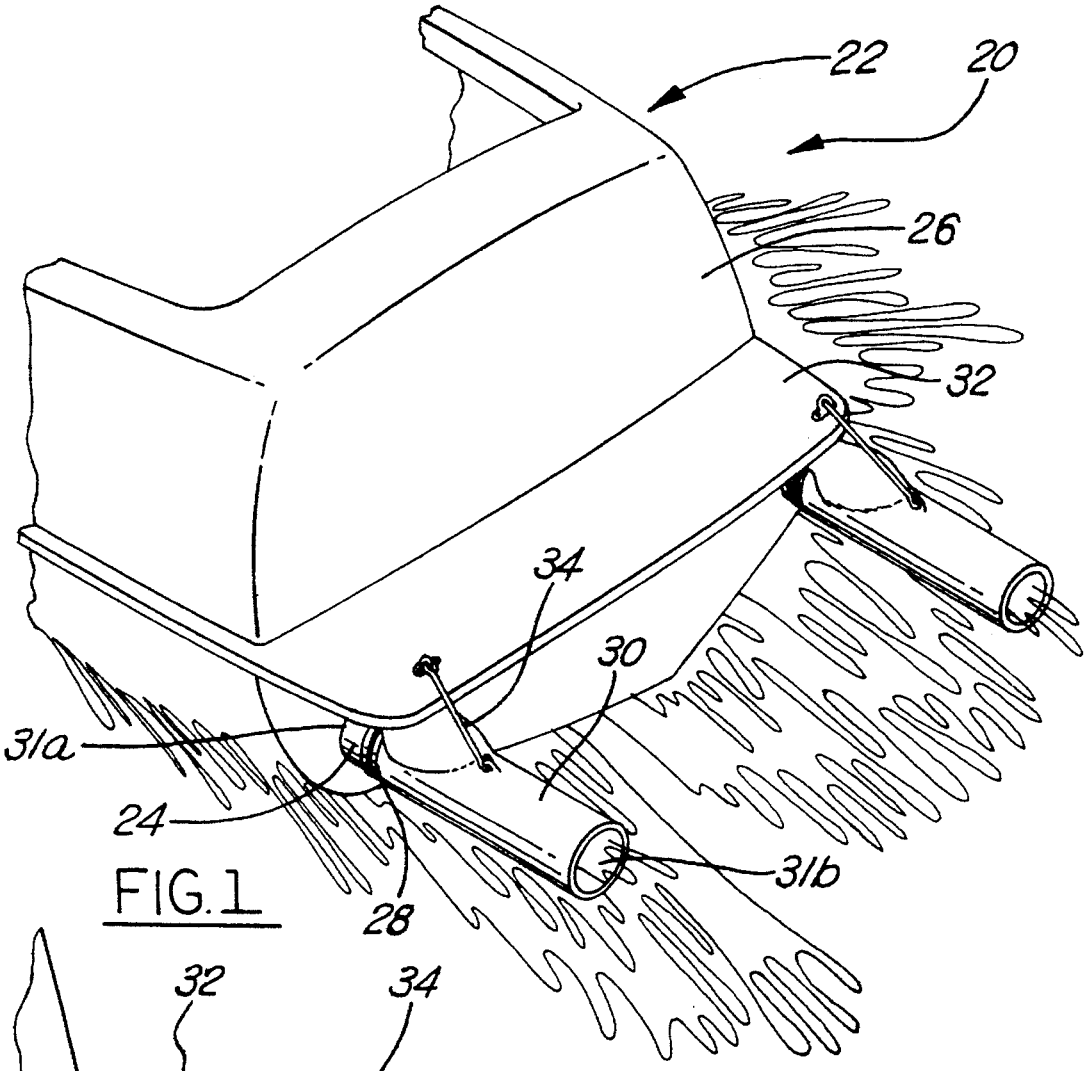
FIG. 1 is a perspective view of a first embodiment of the present invention on a boat.

Referring now to FIG. 1, there is illustrated an apparatus embodying the present invention, shown generally by reference numeral 20, for discharging exhaust gases from a boat 22 driven by an inboard engine. Boat 22 has a pair of exhaust pipes, one of which is shown at 24 extending out from the transom 26. Because the exhaust pipes are identical, only one will be described. Exhaust pipe 24, located near the water line, terminates in an exhaust pipe outlet 28 for discharging exhaust fumes generated by the inboard engine. An elongated tube 30 encircles exhaust pipe outlet 28 at an inlet end 31*a* to receive and to discharge the exhaust fumes at an outlet end 31*b*.

Tube 30 is normally flaccid and collapsibly hangs from exhaust pipe outlet 28, but is capable of assuming a substantially rigid condition. As shown in FIG. 1, tube 30 is substantially rigid when the inboard engine discharges exhaust gases through exhaust pipe 24. Tube 30 conveys the exhaust gases emitted from exhaust pipe 24 and discharges them at outlet end 31*b* which is located a desired distance from boat 22 when tube 30 is substantially rigid. Tube 30 transports and discharges the exhaust gases at such distance from transom 26 as to reduce the likelihood that the gases emitted from exhaust pipe outlet will soil transom 26.

Preferably, a tube support means 34 such as a tether, cord, or elastic band, connects tube 30 to swim platform 32 to prevent tube 30 from extending and engaging with machinery beneath the boat when the engine is stopped or the boat is backing up.

Figure 2:
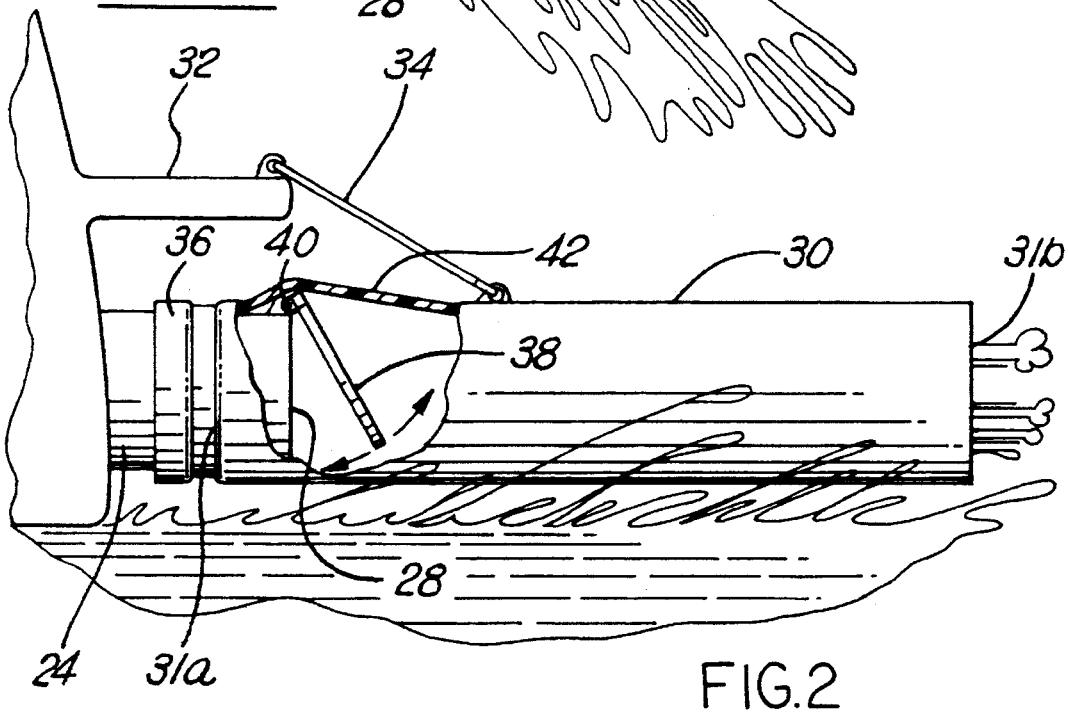
FIG. 2 is a side view, partially in section, of the embodiment of FIG. 1.

Tube 30 encircles exhaust pipe outlet 28 as shown in FIG. 2. Clamping means 36, such as one or more stainless steel rings, grips tube 30 over exhaust pipe outlet 28. Clamping means 36 ensures that tube 30 will remain clamped to exhaust pipe 24 while discharging the exhaust gases.

In keeping with the present invention, a conventional exhaust outlet flap valve 38 pivotally closes exhaust pipe outlet 28 and is disposed within tube 30. Exhaust pipe 24 is provided with a pivot assembly 40. Exhaust flap 38 is mounted to exhaust pipe outlet 28 at pivot assembly 40. As is known in the art, exhaust flap 38 shuts off access to exhaust pipe 24 when the engine is stopped. When the engine is started and generating exhaust gases, the gases have enough pressure to cause exhaust flap 38 to pivot upward allowing the gases to be discharged past exhaust flap 38 and through tube 30.

In the preferred construction, tube 30 may be manufactured of any suitable gas-impermeable, strong but flexible, sheet-like material. For example, a rubberized, vinyl cloth or other elastomer coated woven fabric or the like may be used. The material should, of course, also be suitably resistant to sea water and engine exhaust gases, as well as to the engine exhaust temperatures.

Figure 3:
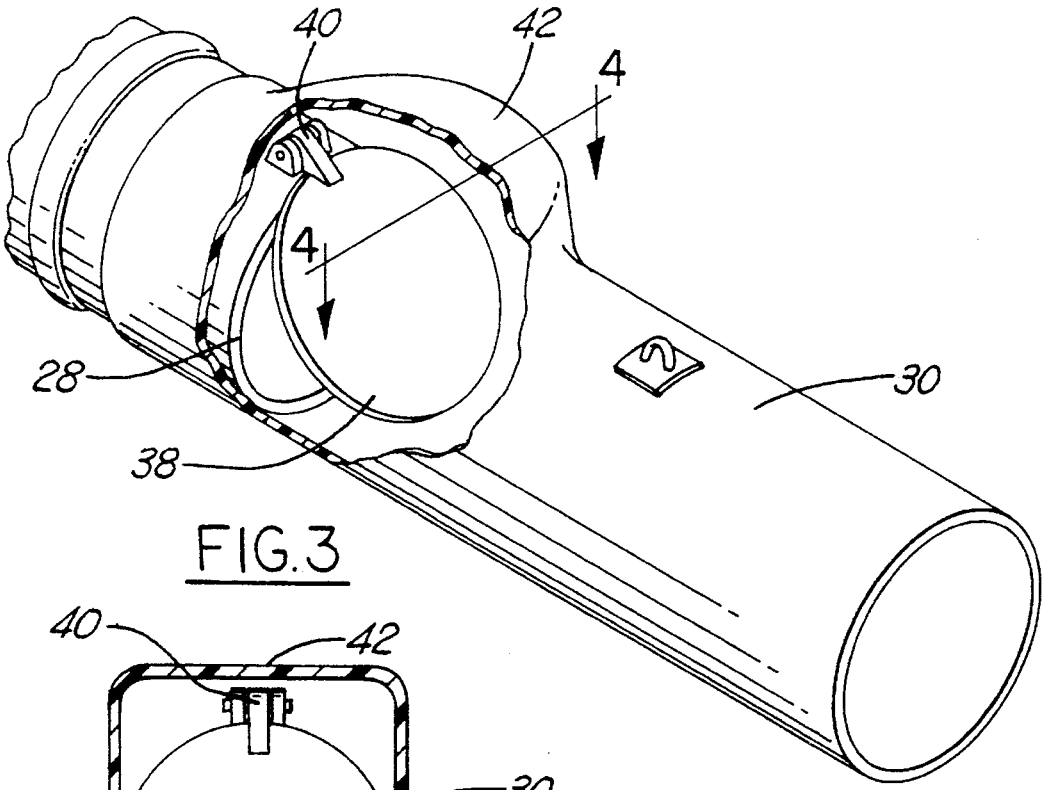
FIG. 3 is a perspective view, partially in section, of the embodiment of FIG. 1 showing the exhaust outlet flap valve.
Figure 4:
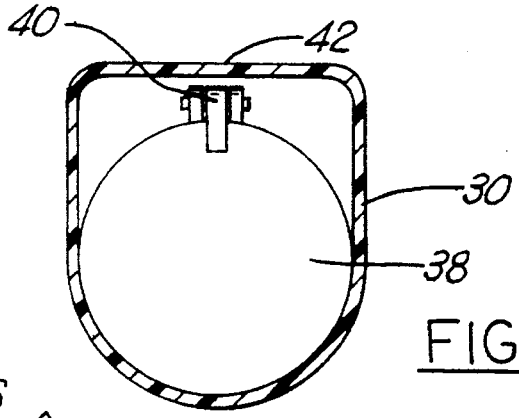
FIG. 4 is cross-sectional view taken on the line 4—4 of FIG. 3.

Tube 30 is provided with a protuberance 42 which fits over pivot assembly 40 for preventing pivot assembly 40 from tearing tube 30. As best shown in FIGS. 3 and 4, protuberance 42 is large enough to allow exhaust flap 38 to be maintained at a right angle to exhaust pipe outlet 28 during periods of maximum exhaust.

Figure 5:
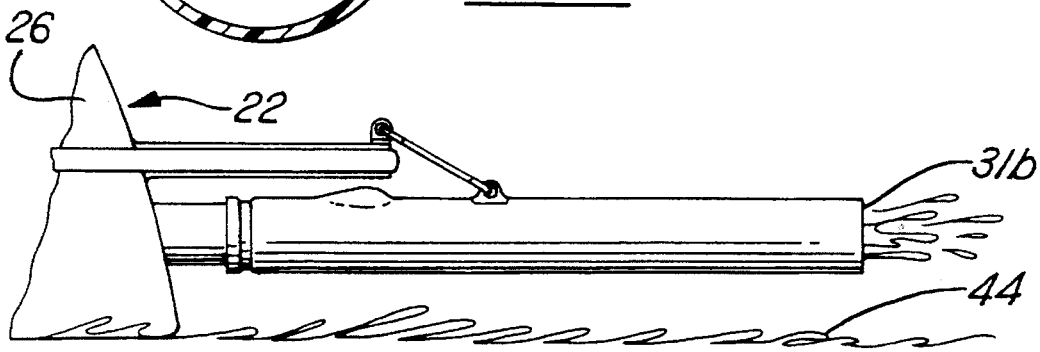
FIG. 5 is a side view of the improved exhaust apparatus when the boat is moving forward.
Figure 6:
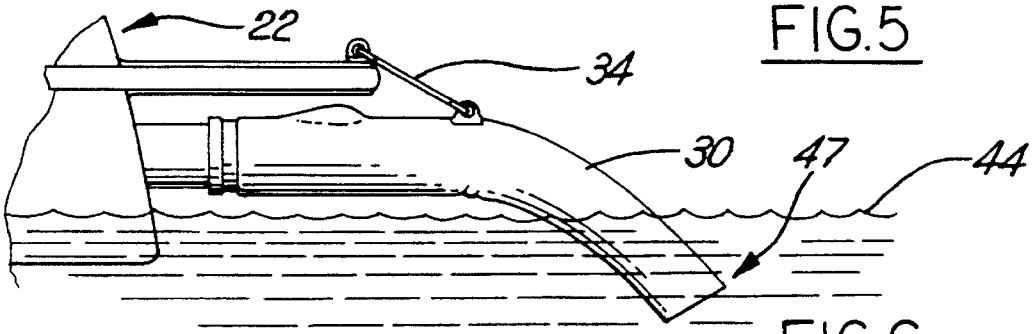
FIG. 6 is a side view of the improved exhaust apparatus when the boat is stationary or backing up.

The operation of apparatus 20 may be further understood upon reference to FIGS. 5 and 6. In FIG. 5, exhaust gases from an operative engine cause tube 30 to become rigid and to extend rearwardly from boat transom 26. The exhaust gas pressure causes tube 30 to lie parallel to and above the water surface 44. Tube 30 discharges the exhaust gases at outlet end **31*b* behind and away from boat 22 and into the atmosphere to avoid back pressure created by the water surrounding boat 22**.

When rigid, tube 30 extends a predetermined distance from boat transom 26. The distance tube 30 extends from transom 26 depends on the length of tube 30. The length is chosen in order to ensure that tube discharges the exhaust gases far enough away from transom 26 to prevent the gases from remaining near and soiling boat 22. It has been determined that a length of around two to three feet will direct the exhaust gases far enough a, way from boat 22 while eliminating the possibility of damage to tube 30 from water waves. However, the required length may vary from boat-to-boat and depends on the size and shape of the transom, speed of the boat and possibly other factors.

When the boat engine is stopped and the exhaust gases are non-existent, tube 30 will be flaccid and extend collapsibly into the water surrounding boat 22 as shown in FIG. 6. As a primary advantage of the present invention, tube 30 does not effectively increase the length of boat 22 during docking operations because the tube will bend or deflect if it contacts a stationary dock or other boat. Thus, while the tube may extend two or more feet aft of the boat when the engine is running, this is not a concern when docking or maneuvering because of the flexibility of the tube. Of course, when the engine is stopped, the tube resumes its flaccid condition and simply droops in the water. When the boat is docked, and during other times when the engine is stopped, a portion of tube 30 is hidden from view by collapsibly extending into the water at 47 and is prevented from extending beneath boat 22 by tether 34.

Figure 7:
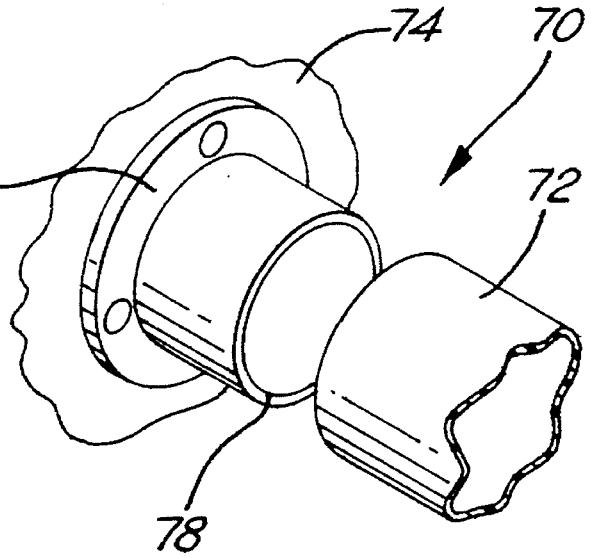
FIG. 7 is a side view of a second embodiment of the present invention.
Figure 8:
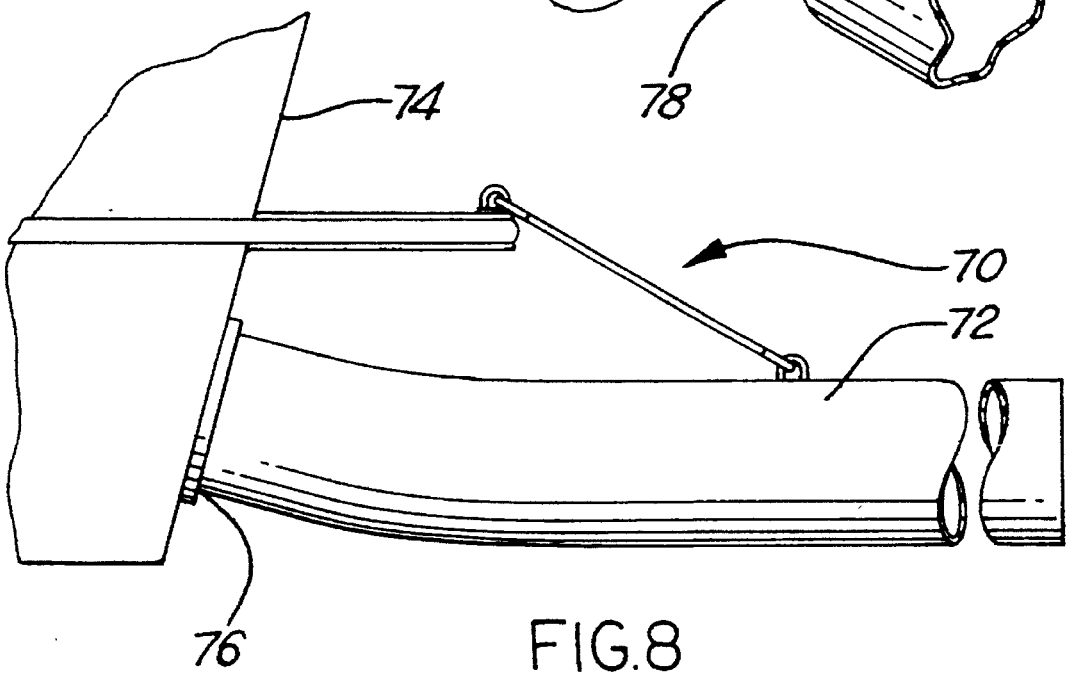
FIG. 8 is an exploded view of the embodiment of FIG. 7.

Referring now to FIGS. 7 and 8, a second embodiment of the present invention is shown generally by reference numeral 70. The second embodiment is preferred when the exhaust pipes extend too short a distance from the boat transom to allow a clamp to clamp the tube directly to the exhaust pipe. As shown in FIG. 8, an elongated tube 72 is mounted at one end to the boat transom 74. Mounting means 76, such as an annular flange, encircles exhaust pipe 77 and is secured to transom 74. Annular flange 76 receives and mounts tube 72 to transom 74. Flange 76 ensures that tube 72 will not be blown off exhaust pipe outlet 78 by pressure from the exhaust fumes.

It is to be understood, of course, that while the forms of the invention described above constitute the preferred embodiments of the present invention, the preceding description is not intended to illustrate all possible forms thereof. It is also to be understood that the words used are words of description, rather than of limitation, and that various changes may be made without departing from the spirit and scope of the present invention, which should be construed according to the following claims.

We claim:

1. An apparatus for preventing soiling of a boat transom by exhaust gases generated by an inboard engine which are emitted from an exhaust pipe outlet at the transom, said apparatus comprising:

an elongated normally flaccid tube having an inlet end communicating with the exhaust pipe outlet at the transom and an outlet end;

said tube becoming rigid and extending rearwardly from the transom upon pressurizing the interior of the tube by operation of the inboard engine discharging the exhaust gases through said tube; and said outlet end of said tube being disposed sufficiently rearwardly from the transom, when said tube is rigid, to discharge the exhaust gases remote from the transom and prevent soiling.

2. The apparatus of claim 1 wherein the exhaust pipe outlet at the transom projects rearwardly from the transom and said inlet end of said tube is clamped thereto.

3. The apparatus of claim 1 further comprising an annular flange encircling the exhaust pipe outlet at the transom and secured to the transom, said inlet end of said tube is mounted to said flange.

4. The apparatus of claim 1 further comprising a tether connected to said tube, said tether extending upwardly from said tube and connected to the boat for holding up said tube to prevent it from engaging with boat machinery below the surface of the water when the boat engine is inoperative and said tube is flaccid.

5. The apparatus of claim 2 further comprising a tether connected to said tube, said tether extending upwardly from said tube and connected to the boat for holding up said tube to prevent it from engaging with boat machinery below the surface of the water when the boat engine is inoperative and said tube is flaccid.

6. The apparatus of claim 3 further comprising a tether connected to said tube, said tether extending upwardly from said tube and connected to the boat for holding up said tube to prevent it from engaging with boat machinery below the surface of the water when the boat engine is inoperative and said tube is flaccid.

* * * * *